United States Patent [19]

Shibata et al.

[11] Patent Number: 4,743,532

[45] Date of Patent: May 10, 1988

[54] SILVER HALIDE PHOTOGRAPHIC EMULSION HAVING SPECIFIC RELATIVE STANDARD DEVIATION OF THE SILVER CHLORIDE CONTENT

[75] Inventors: Yoshinori Shibata; Tadashi Ito, both of Kanagawa, Japan

[73] Assignee: Fuji Photo Film Co., Ltd., Kanagawa, Japan

[21] Appl. No.: 905,816

[22] Filed: Sep. 10, 1986

[30] Foreign Application Priority Data

Sep. 12, 1985 [JP] Japan ..... 60-202275

[51] Int. Cl.[4] ..... G03C 1/02

[52] U.S. Cl. ..... 430/564; 430/567; 430/569

[58] Field of Search ..... 430/564, 567, 569

[56] References Cited

U.S. PATENT DOCUMENTS

| | | | |
|---|---|---|---|
| 4,349,622 | 9/1982 | Koitabashi et al. | 430/568 X |
| 4,507,386 | 3/1985 | Matsuzaka et al. | 430/567 X |
| 4,591,549 | 5/1986 | Matsuzaka et al. | 430/567 X |
| 4,640,889 | 2/1987 | Komorita et al. | 430/567 X |
| 4,661,441 | 4/1987 | Kajawara et al. | 430/567 X |

FOREIGN PATENT DOCUMENTS

| | | |
|---|---|---|
| 0147868 | 7/1985 | European Pat. Off. . |
| 2126742 | 3/1984 | United Kingdom . |

*Primary Examiner*—Mukund J. Shah

*Attorney, Agent, or Firm*—Sughrue, Mion, Zinn, Macpeak, and Seas

[57] ABSTRACT

A silver halide photographic emulsion and a process for preparing the same are disclosed, wherein the emulsion has a composition of the formula:

$$AgBr_{1-x-y}Cl_xI_y$$

wherein x is a molar fraction satisfying the formula $0<x\leqq 0.6$, and y is a molar fraction satisfying the formula $0\leqq y\leqq 0.01$, wherein the relative standard deviation of the silver chloride content of individual silver halide grains is not more than about 20%. The emulsion has improved preservability in a liquid state during the period from its initial preparation through the coating step.

12 Claims, 2 Drawing Sheets

SILVER HALIDE PHOTOGRAPHIC EMULSION HAVING SPECIFIC RELATIVE STANDARD DEVIATION OF THE SILVER CHLORIDE CONTENT

FIELD OF THE INVENTION

This invention relates to a silver halide photographic emulsion and, more particularly, to a silver halide photographic emulsion having improved preservability from the initial preparation of the emulsion through the step of coating.

BACKGROUND OF THE INVENTION

In the production of silver halide photographic materials, a silver halide photographic emulsion is usually prepared by mixing a solution containing a silver ion with a solution containing a halide in a protective colloid by various methods to form fine silver halide grains, subjecting the resulting emulsion to sensitization by, for example, using a chemical sensitizer and, if desired, adding various photographic additives thereto. The thus-prepared silver halide emulsion is then coated on a support, followed by drying. A silver halide emulsion should, therefore, necessarily pass through a liquid state before being coated. Conditions for preserving the emulsion from the time of prepration until it is coated on the support (such as temperature, time, stirring conditions, etc.) influence certain photographic characteristics of the resulting photographic materials, such as sensitivity, gradation, fog, and the like. In fact, it is rare to obtain consistent photographic characteristics of silver halide photographic materials, i.e., it is difficult to always ensure high reproducibility in photographic characteristics even if the conditions for producing the silver halide photographic materials are as strictly controlled as possible to avoid fluctuations. In order to impart consistent photographic performance properties to silver halide photographic materials, it is essential to prepare a silver halide emulsion which exhibits excellent preservability during the period from its preparation through coating.

Known methods for improving the stability of silver halide emulsions during this period of preservation while the emulsion is in a liquid state include a method disclosed in Japanese Patent Application (OPI) No. 217928/83 (the term "OPI" as used herein refers to a "published unexamined Japanese Patent Application"), in which a mercaptoimidazole type compound and/or a triazole type compound is/are added to a silver halide photographic emulsion to improve its preservability; a method disclosed in Japanese Patent Application (OPI) No. 9658/84, in which a sensitizing dye is added to a silver halide emulsion after completion of chemical ripening and before coating to improve preservability of the emulsion; and a method disclosed in Japanese Patent Application (OPI) No. 29243/84, in which production stability of silver halide photographic materials can be improved by constructing the outer surface of silver halide grains with a {111} face and a {100} face at a given area ratio.

However, these methods do not improve liquid stage preservability of silver halide emulsions to a level satisfactory for practical usage. Further, even if the object of improving preservability to a desired level is achieved, secondary effects produced by these methods may interfere with the expected photographic characteristics of the resulting silver halide photographic materials. More specifically, it is possible to keep photographic characteristics of a silver halide emulsion consistent during the period from the initial emulsion preparation to coating by incorporating a mercaptoimidazole type compound and/or a triazole type compound into the silver halide emulsion as taught by Japanese Patent Application (OPI) No. 217928/83. However, addition of these compounds in amounts sufficient to produce such an effect on preservability hinders development of the resulting silver halide photographic materials, resulting in a reduction in sensitivity. Further, it is possible to maintain the photographic characteristics of a silver halide emulsion during the period from the initial emulsion preparation through the coating step by incorporating a sensitizing dye into the emulsion in an amount larger than is usually necessary for sensitization, as disclosed in Japanese Patent Application (OPI) No. 9658/84, but addition of a sensitizing dye in such an amount concomitantly causes a reduction in sensitivity in the inherently sensitive region. When this method is applied to color light-sensitive materials, the sensitizing dye present in the silver halide emulsion layer diffuses into other light-sensitive layers, ultimately resulting in unfavorable influences on photographic performances, such as a deterioration of color reproducibility. In addition, in those of the above-described techniques where an adsorbing substance is adsorbed onto the surfaces of silver halide grains in an emulsion, a resulting effect of maintaining the photographic characteristics consistent may occur. This effect occurs through the prevention of recrystallization of the silver halide grains due to a difference of individual grains in size or halogen composition in a liquid state. However, when the adsorbing substance is present in the liquid state silver halide emulsion, equilibrium is attained through repetitive absorption of this substance onto the silver halide grains and subsequent desorption therefrom. Therefore, even if the adsorbing substance, when viewed macroscopically, appears to be adsorbed on the silver halide grains, recrystallization of silver halide grains due to differences in size or halogen composition cannot be adequately inhibited. In these circumstances, the silver halide grains in a liquid state undergo changes with the passage of time, resulting in the photographic characteristics of the silver halide emulsion fluctuating over time. Furthermore, in the method disclosed in Japanese Patent Application (OPI) No. 29243/84, if the individual silver halide grains have a difference in halogen composition among themselves, a thermodynamic effect occurs such that the silver halide grains are dissolved whereby the composition of the grains becomes more uniform as to the halogen component. As a result, the silver halide grain composition in the emulsion changes. Therefore, this technique cannot also sufficiently inhibit fluctuations of the photographic characteristics of the emulsion in a liquid state with the passage of time.

Hence, all of the conventional techniques as mentioned above fail to sufficiently improve preservability of a silver halide emulsion in a liquid state because no technical improvements have been made in connection with the thermodynamic stability of the silver halide grains per se.

SUMMARY OF THE INVENTION

Accordingly, an object of this invention is to provide a silver halide photographic emulsion having improved preservability during the period from the initial emulsion preparation through the coating step.

This object can be accomplished by a silver halide emulsion having a composition of the formula (1)

$$AgBr_{1-x-y}Cl_xI_y \quad (1)$$

wherein x is a molar fraction satisfying the formula $0<x\leqq 0.6$, and y is a molar fraction satisfying the formula $0\leqq y\leqq 0.01$, wherein the relative standard deviation of the silver chloride content of individual silver halide grains is not more than about 20%.

The above-described silver halide emulsion not only exhibits improved preservability during the period from its preparation through coating but also, when used in combination with other emulsions, each having a different average grain size, it becomes relatively simpler to control the characteristic curve, i.e., gradation, of the resulting silver halide light-sensitive material.

DETAILED DESCRIPTION OF THE INVENTION

Figure 1:
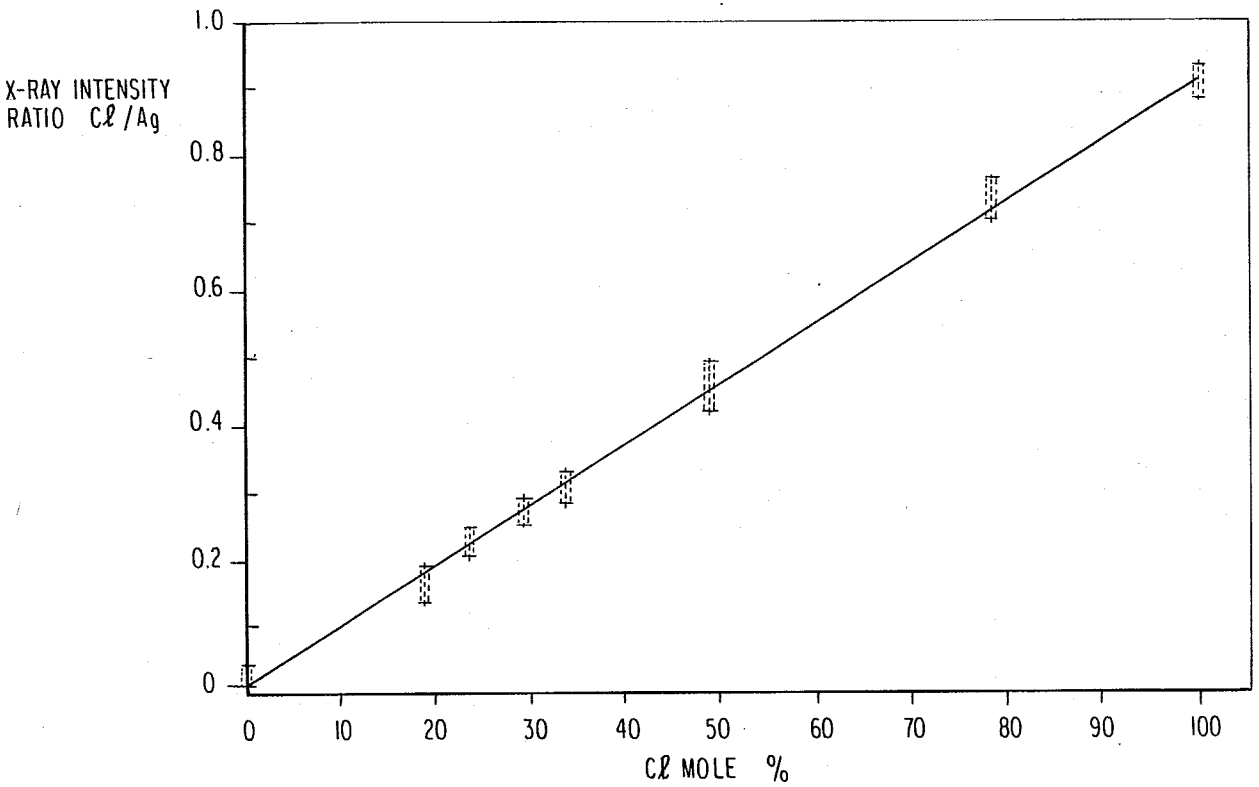
FIG. 1 shows a calibration curve of counted amount for chlorine/counted amount for silver plotted against silver chloride content with respect to AgBrCl system, in which the abscissa indicates a silver chloride content (mol%) as measured by X-ray diffractometry, the ordinate indicates a counted amount for chlorine/counted amount for silver ratio (X-ray intensity ratio), and each plot corresponds to one emulsion grain.

Examples of the methods for preparing the emulsion of the above-described silver halide and the method for measuring the halogen composition distribution of the silver halide grains in the emulsion are shown below.

The present inventors have succeeded in obtaining a silver halide emulsion having improved preservability in a liquid state from the initial emulsion preparation to the coating step by adding an aqueous silver nitrate solution and an aqueous alkali metal halide solution to an aqueous gelatin solution containing an alkali metal halide while maintaining a constant pAg value according to a double jet method, followed by mixing, subjecting the mixture to physical ripening and stopping the physical ripening before substantial increases in grain size distribution occur and then desalting (washing) so as to make the halogen composition distribution among the silver halide grains as narrow as possible.

Halogen composition distribution of silver halide grains has hitherto been determined by powder X-ray diffractometry as described, e.g., in Japanese Patent Application (OPI) No. 110926/81, but this method is, in principle, incapable of distinguishing between halogen composition distribution among the grains (hereinafter referred to as intergranular distribution) and internal halogen composition distribution in individual grains (hereinafter referred to as intragranular distribution). If the halogen composition of silver halide grains is analyzed only by powder X-ray diffractometry, it is difficult to systematically establish guidelines for designing a silver halide emulsion by specifying an intergranular halogen composition distribution of the silver halide grains. Thus, the inventors examined halogen compositions of individual grains by the use of an X-ray microanalyzer as described below.

The silver chloride content of individual grains can be measured by analyzing each silver halide grain of a composition by means of an X-ray microanalyzer. The term "relative standard deviation of a silver chloride content of individual grains" as herein used means a value obtained by measuring silver chloride contents of at least 100 grains by an X-ray microanalyzer to obtain a standard deviation of silver chloride content, dividing the standard deviation by the average silver chloride content, and multiplying the quotient by 100.

To measure the silver chloride content of the individual grains, a sample of an emulsion to be measured is dissolved at a temperature of 40° C. or lower, and the solution is then diluted about 100 times with distilled water at ordinary temperature to disperse the silver halide grains therein. The resulting dispersion is spread on a plate, followed by drying. After carbon is deposited on the sample by vacuum evaporation, the resulting sample is analyzed by an X-ray microanalyzer. The X-ray microanalyzer contemplated for use may be any of commercially available general apparatuses, with no special equipment required. Measurement can be carried out by irradiating individual grains with electron rays and measuring the characteristic X-ray intensity of each element excited by the electron rays by means of a dispersed type X-ray spectrometer. Spectral crystals used for analysis of each element and wavelengths of the characteristic X-ray of each element are shown in Table 1 below.

The silver chloride content of the individual grains can be determined from the characteristic X-ray intensity of each element by a calibration curve as shown in FIG. 1 which is prepared by measuring the characteristic X-ray intensity of silver halide grains whose silver chloride content is known.

TABLE 1

| Element | Wavelength (analysis line) | Spectral Crystal |
|---|---|---|
| Ag | 4.154Å (Ag—$L_{\alpha 1}$) | PET*1 |
| Br | 8.375Å (Br—$L_{\alpha 1}$) | RAP*2 |
| Cl | 4.729Å (Cl—$K_{\alpha 1,2}$) | PET*1 |

Note:
*1Pentaerythritol
*2Rubidium phthalate

In a preferred embodiment of the light-sensitive silver halide emulsion according to the present invention, the relative standard deviation of silver chloride content is not more than 10%.

Size distribution of the emulsion of the invention is not essentially limited, but the emulsion is preferably monodispersed. The term "monodispersed" means that a coefficient of variation δ as defined by the following equation (3), wherein a mean grain size $\bar{d}$ is defined by the following equation (2), is not more than about 15%, and preferably not more than 10%.

When $n_1$ grains have a grain size $d_1$, $n_2$ grains have a grain size $d_2$, and $n_i$ grains have a grain size $$d_i\left(N=\sum_{i=1}^{k} n_i\right),$$

-continued $$\bar{d} = \sum_{i=1}^{k} n_i d_i / N \quad (2)$$

$$\delta = \left\{ \left[ \sum_{i=1}^{k} n_i (d_i - \bar{d})^2 / N \right]^{\frac{1}{2}} / \bar{d} \right\} \times 100 \quad (3)$$

The crystal structure is not particularly limited, but normal crystals are preferable to abnormal crystals. In particular, cubic crystals and octahedral crystals are preferred.

Preferred silver halide grains are those having a chloride content of not more than about 60 mol%, with no substantial iodide content, more preferably those having a chloride content of from 5 to 55 mol%, and most preferably from 10 to 50 mol%.

The silver halide grains preferably have an average grain size of from about 0.2 to about 1.3 μm, more preferably from 0.3 to 1.0 μm, and most preferably from 0.4 to 0.8 μm.

In order to fix the silver chloride content of the individual grains, an aqueous solution of silver nitrate and an aqueous solution of a mixture of alkali metal iodide, bromide and chloride are mixed in the presence of a protective colloid in accordance with a double jet method. In view of the desire to narrow the intergranular silver chloride content distribution, it is important that the pAg value of the liquid phase during the addition be controlled to fall within a range of from about 6.0 to about 10.0, and preferably from 6.5 to 9.0. Further, it is particularly important that the emulsion, after the grain formation, be subjected to physical ripening at a temperature between about 40° C. and about 75° C. not to impair the monodispersed property of the emulsion and then the physical ripening of the grains is abruptly stopped.

During the formation of silver halide grains or the physical ripening thereof, a cadmium salt, a zinc salt, a lead salt, a thallium salt, an iridium salt or a complex salt thereof, an iron salt or a complex salt thereof, etc., may be present.

In the present invention, in order to further ensure preservability of the silver halide emulsion during the period from its preparation to the coating step, the above-recited techniques disclosed in Japanese Patent Application (OPI) Nos. 217928/83, 9658/84 and 29243/84 can be applied in combination.

Known silver halide solvents can be employed in the preparation of the photographic emulsion of the invention. Silver halide solvents which are often used include ammonia, thioethers, thioureas, thiocyanates, thiazolinethiones, and the like. Examples of suitable thioethers are described in U.S. Pat. Nos. 3,271,157, 3,574,628 and 3,790,387; thioureas as set forth in, for example, Japanese Patent Application (OPI) Nos. 82408/78 and 77737/80; thiocyanates are disclosed in, for example, U.S. Pat. Nos. 2,222,264, 2,448,534 and 3,320,069; and thiazolinethiones are stated to be useful in, for example, Japanese Patent Application (OPI) No. 144319/78.

The silver halide grains of the present invention may be subjected to chemical sensitization, if desired. Chemical sensitization can be carried out by sulfur sensitization using active gelatin or compounds containing sulfur capable of reacting with silver (e.g., thiosulfates, thioureas, mercapto compounds, rhodanines, etc.); reduction sensitization using a reducing substance (e.g., stannous salts, amines, hydrazine derivatives, formamidinesulfinic acid, silane compounds, etc.); noble metal sensitization using noble metal compounds (e.g., gold complex salts, complex salts of metals of Periodic Table Group VIII, such as Pt, Ir, Pd, etc.); or a combination thereof.

Sulfur sensitization is described in, for example, U.S. Pat. Nos. 1,574,944, 2,278,947, 2,410,689, 2,728,668 and 3,656,955; reduction sensitization is described in, for example, U.S. Pat. Nos. 2,419,974, 2,983,609 and 4,054,458; and noble metal sensitization is disclosed in, for example, U.S. Pat. Nos. 2,399,083 and 2,448,060 and British Pat. No. 618,061.

From the standpoint of using silver economically, chemical sensitization of the silver halide grains is preferably effected by gold sensitization, sulfur sensitization or a combination thereof.

If desired, the silver halide grains of the invention may be spectrally sensitized with known methine dyes, such as cyanine dyes, merocyanine dyes, and the like. These sensitizing dyes can be used at any of (1) the stage comprising grain formation; (2) the stage of from about the midpoint of the physical ripening of the grains through the stage before chemical sensitization; and (3) the stage of from about the midpoint of chemical sensitization through the stage before coating. The sensitizing dyes are preferably employed at the stage (2) above.

Various color couplers can be used in the present invention. Examples of useful color couplers include cyan couplers (e.g., naphthol type or phenol type compounds), magenta couplers (e.g., pyrazolone type or pyrazoloazole type compounds) and yellow couplers (e.g., open chain or heterocyclic ketomethylene compounds). Specific examples of the cyan, magenta and yellow couplers which can be used in this invention are described in patents cited in *Research Disclosure,* No. 17643, VII-D (December, 1978) and *Research Disclosure,* No. 18717 (November, 1979).

It is preferable that color couplers to be incorporated into the light-sensitive materials have a ballast group or be in polymeric form so as to be capable of rendering the coupler nondiffusible. 2-Equivalent color couplers wherein the active coupling position is substituted with a releasable group are preferred to 4-equivalent color couplers wherein the active coupling position is a hydrogen atom, since the former requires smaller silver coverages. Couplers which produce dyes properly smearing, colorless compound forming couplers, DIR couplers capable of releasing developing inhibitors upon coupling reaction or couplers capable of releasing developing accelerators upon coupling reaction may also be used.

Typical examples of yellow couplers to be used in the present invention are oil-protected acylacetamide couplers; specific examples thereof are described in U.S. Pat. Nos. 2,407,210, 2,875,057 and 3,265,506. 2-Equivalent yellow couplers are preferred in this invention. Examples of such yellow couplers include yellow couplers having oxygen atom-linked coupling off groups as described in U.S. Pat. Nos. 3,408,194, 3,447,928, 3,933,501 and 4,022,620, and yellow couplers having nitrogen atom-linked coupling off groups as described in Japanese Patent Publication No. 10739/83, U.S. Pat. Nos. 4,401,752 and 4,326,024, *Research Disclosure,* No. 18053 (April, 1979), British Pat. No. 1,425,020, and West German Patent Application (OLS) Nos. 2,219,917, 2,261,361, 2,329,587 and 2,433,812. α-

Pivaloylacetanilide type couplers are excellent in fastness, particularly to light, of the produced dye, and α-benzoylacetanilide couplers provide high color densities.

Magenta couplers which can be used include oil-protected indazolone type couplers, cyanoacetyl type couplers, and preferably 5-pyrazolone type couplers and pyrazoloazole type couplers, such as pyrazolotriazoles. Of the 5-pyrazolone type couplers, those having an arylamino or acylamino group at the 3-position are preferred in view of the hues or densities of the dye produced. Typical examples of such couplers are described, e.g., in U.S. Pat. Nos. 2,311,082, 2,343,703, 2,600,788, 2,908,573, 3,062,653, 3,152,896 and 3,936,015. Releasable groups for 2-equivalent 5-pyrazolone couplers preferably include nitrogen atom-linked coupling off groups as described in U.S. Pat. No. 4,310,619 and arylthio groups as described in U.S. Pat. No. 4,351,897. The 5-pyrazolone couplers having a ballast group, as disclosed in European Pat. No. 73,636, provide high color densities.

The pyrazoloazole type couplers include pyrazolobenzimidazoles as described in U.S. Pat. No. 3,061,432, preferably pyrazolo[5,1-c][1,2,4]triazoles as described in U.S. Pat. No. 3,725,067, pyrazolotetrazoles as described in *Research Disclosure,* No. 24220 (June, 1984) and pyrazolopyrazoles as described in *Research Disclosure,* No. 24230 (June, 1984). In view of less side absorption of yellow and light fastness of dyes produced, the imidazolo[1,2-b]pyrazoles described in European Pat. No. 119,741 are preferred, and the pyrazolo[1,5-b][1,2,4]triazoles described in European Pat. No. 119,860 are particularly preferred.

Couplers which produce dyes properly smearing can be used in combination. Examples of such couplers are described in U.S. Pat. No. 4,366,237 and British Pat. No. 2,125,570 (magenta couplers); and in European Pat. No. 96,570 and West German Patent Application (OLS) No. 3,234,533 (yellow, magenta and cyan couplers).

The dye-forming couplers and the above-described special couplers except for those which produce diffusible dyes may exist as polymers, including dimers. Typical examples of polymerized dye-forming couplers are given in U.S. Pat. Nos. 3,451,820 and 4,080,211. Specific examples of polymerized magenta couplers are given in British Pat. No. 2,102,173 and U.S. Pat. No. 4,367,282.

For the purpose of satisfying characteristics required for light-sensitive materials, two or more of these various couplers may be incorporated into the same layer, or two or more layers may contain the same coupler.

A generally used amount of the color coupler is from about 0.001 to about 1 mol per mol of the light-sensitive silver halide. Preferably, the yellow coupler is used in an amount of from 0.01 to 0.5 mol, the magenta coupler is used in an amount of from 0.003 to 0.3 mol, and the cyan coupler is used in an amount of from 0.002 to 0.3 mol, each per mol of the silver halide.

For the purpose of preventing fog during the preparation, preservation or photographic processing of the light-sensitive materials or stabilizing photographic performances of the light-sensitive materials, the photographic emulsion to be used in the present invention can further contain various compounds known as antifoggants or stabilizers, such as azoles, e.g., benzothiazolium salts, benzimidazolium salts, imidazoles, benzimidazoles (preferably, 5-nitrobenzimidazoles), nitroindazoles, benzotriazoles (preferably 5-methylbenzotriazoles), triazoles, etc.; mercapto compounds, e.g., mercaptothiazoles, mercaptobenzothiazoles, mercaptobenzimidazoles, mercaptobenzoxazoles, mercaptoxadiazoles, mercaptothiadiazoles (especially 2-amino-5-mercapto-1,3,4-thiadiazole, etc.), mercaptotriazoles, mercaptotetrazoles (especially 1-phenyl-5-mercaptotetrazole, etc.), mercaptopyrimidines, mercaptotriazines, etc.; thiocarbonyl compounds, e.g., oxazolinethione, etc.; azaindenes, e.g., triazaindenes, tetraazaindenes (especially 4-hydroxy-6-methyl(1,3,3a7)tetraazaindene), pentaazaindenes, etc.; benzenethiosulfonic acids, benzenesulfinic acids, benzenesulfonic acid amides; purines, e.g., adenine, etc.; and the like.

Specific examples of these antifoggants or stabilizers and usages thereof are described in, for example, U.S. Pat. Nos. 3,954,474 and 3,982,947, Japanese Patent Publication No. 28660/77, *Research Disclosure,* No. 17643, VIA-VIM (December, 1978) and E. J. Birr, *Stabilization of Photographic Silver Halide Emulsion,* Focal Press (1974).

The present invention can also be applied to multilayer multicolor photographic materials comprising a support having provided thereon at least two layers having different spectral sensitivities. The multilayer natural color photographic materials comprise a support usually having provided thereon at least one red-sensitive emulsion layer, at least one green-sensitive emulsion layer and at least one blue-sensitive emulsion layer. The order of these layers can be arbitrarily selected according to the desires of the skilled artisan. Each of the above-described emulsion layers may be composed of two or more layers having different sensitivities. Further, a light-insensitive layer may be present between each group of emulsion layers having the same sensitivity.

It is preferable that the light-sensitive materials of the present invention contain, in addition to the silver halide emulsion layers, auxiliary layers, such as a protective layer, an intermediate layer, a filter layer, an antihalation layer, a backing layer and the like.

The photographic emulsion layers and other layers are coated on a support commonly employed in photographic light-sensitive materials, such as flexible supports including plastic films, paper, cloth, etc., and rigid supports including glass, ceramics, metals, etc. Preferred supports are baryta paper and paper supports laminated with polyethylene having dispersed therein a white pigment, e.g., titanium oxide.

The present invention can be applied to various black-and-white or color light-sensitive materials, including black-and-white films for printing, films for medical use, color negative films for general use or for motion pictures, color reversal films for slides or TV, color papers, color positive films, color reversal papers, and the like. The present invention is preferably applied, inter alia, to color papers or color positive films. In addition, the present invention is also applicable to black-and-white light-sensitive materials utilizing mixing of three color couplers as described, e.g., in *Research Disclosure,* No. 17123 (July, 1978).

A color developer to be used for development of the light-sensitive materials prepared in accordance with the present invention is preferred to be an alkaline aqueous solution containing an aromatic primary amine developing agent as a main component. The color developing agent preferably includes p-phenylenediamine type compounds, and typical examples thereof are 3-methyl-4-amino-N,N-diethylaniline, 3-methyl-4-amino-N-ethyl-N-β-hydroxyethylaniline, 3-methyl-4-amino- N-ethyl-N-β-methanesulfonamidoethylaniline, 3-methyl-4-amino-N-ethyl-N-β-methoxyethylaniline and their sulfates, hydrochlorides or p-toluenesulfonates, and the like.

After exposure to light and color development, the light-sensitive materials are subjected to bleaching and fixing either separately or simultaneously using a monobath.

Bleaching agents to be used include organic complex salts of iron (III) or cobalt (III) with aminopolycarboxylic acids, e.g., ethylenediaminetetraacetic acid, diethylenetriaminepentaacetic acid, nitrilotriacetic acid, 1,3-diamino-2-propanoltetraacetic acid, etc., or organic acids, e.g., citric acid, tartaric acid, malic acid, etc. Of these, ethylenediaminetetraacetate iron (III) complex salts and ethylenetriaminepentaacetate iron (III) complex salts are particularly useful in a bleach-fix bath.

Fixing agents which can be used include thiosulfates, thiocyanates, thioether type compounds, thioureas, a large number of iodides, etc., with thiosulfates being commonly employed.

After the bleach-fix processing or fixing processing, the light-sensitive materials are usually subjected to washing. This washing step is generally carried out in a countercurrent system using two or more tanks to save water. Instead of washing, a multistage countercurrent stabilization processing as described in Japanese Patent Application (OPI) No. 8543/82 may be effected.

The color developing agent may be incorporated into the light-sensitive materials for the purpose of simplification and speeding-up of the processing. To this effect, use of various precursors of color developing agents is preferred.

If desired, the light-sensitive materials of the invention may contain therein various 1-phenyl-3-pyrazolidones for the purpose of accelerating color development.

This invention will now be illustrated in greater detail with reference to the following Example, but it should be understood that the Example is not intended to limit the present invention. In this Example, the average grain size and coefficient of variation are those measured by electron micrography on 600 silver halide grains. Unless otherwise indicated, all parts, percents, ratios and the like are by weight.

EXAMPLE

Preparation of Silver Halide Emulsion (1) Silver Halide Emulsion A

A silver nitrate aqueous solution [Solution (2)] was added to a gelatin aqueous solution containing an alkali halide [Solution (1)] at 67° C. over 20 minutes according to a usual single jet method. The mixture was subjected to physical ripening for 10 minutes and then quenched to obtain $AgBr_{0.7994}Cl_{0.1980}I_{0.0026}$ having an average grain size of 0.785 μm and a coefficient of variation of 23.34%. After desalting and washing in a usual manner, the emulsion was subjected to chemical sensitization with sodium thiosulfate under optimum conditions. The resulting silver halide emulsion was designated as Emulsion A.

(2) Silver Halide Emulsion B

A silver nitrate aqueous solution [Solution (4)] and an alkali halide aqueous solution [Solution (5)] were added to a gelatin aqueous solution containing an alkali halide [Solution (3)] at 75° C. over 40 minutes in accordance with a usual double jet method. The emulsion was physically ripened for 10 minutes and then quenched to obtain $AgBr_{0.7994}Cl_{0.1977}I_{0.0029}$ having an average grain size of 0.765 μm and a coefficient of variation of 26.77%. After desalting and washing in a usual manner, the emulsion was subjected to chemical sensitization with sodium thiosulfate under optimum conditions. The resulting silver halide emulsion was designated as Emulsion B.

(3) Silver Halide Emulsion C

A silver nitrate aqueous solution [Solution (4)] and an alkali halide aqueous solution [Solution (5)] were added to a gelatin aqueous solution containing an alkali halide [Solution (3)] at 75° C. over 40 minutes while maintaining the pAg value at 6.99 in accordance with a usual controlled double jet method. The mixture was physically ripened for 10 minutes and then quenched to obtain $AgBr_{0.7994}Cl_{0.1979}I_{0.0027}$ having an average grain size of 0.774 μm and a coefficient of variation of 9.87%. After desalting and washing in a usual manner, the mixture was subjected to chemical sensitization with sodium thiosulfate under optimum conditions. The resulting silver halide emulsion was designated as Emulsion C.

(4) Silver Halide Emulsion D

Silver halide grains were formed in the same manner as for Emulsion C but continuing the physical ripening for double the time while maintaining at 75° C., followed by quenching to obtain $AgBr_{0.7994}Cl_{0.1979}I_{0.0027}$ having an average grain size of 0.775 μm and a coefficient of variation of 9.88%. After desalting and washing in a usual manner, the emulsion was subjected to chemical sensitization with sodium thiosulfate under optimum conditions. The resulting silver halide emulsion was designated as Emulsion D.

Solutions (1) to (5) noted above were formed as follows:

| | |
|---|---|
| Solution (1): | |
| Gelatin | 20 g |
| NaCl | 12 g |
| KBr | 56 g |
| KI | 0.25 g |
| $H_2O$ | 1,000 ml |
| Solution (2): | |
| $AgNO_3$ | 100 g |
| $H_2O$ | 776 ml |
| Solution (3): | |
| Gelatin | 20 g |
| NaCl | 30 g |
| KI | 0.26 g |
| $H_2O$ | 500 ml |
| Solution (4): | |
| $AgNO_3$ | 100 g |
| $H_2O$ | 553 ml |
| Solution (5): | |
| KBr | 56 g |
| $H_2O$ | 553 ml |

The silver chloride contents of the grains in Emulsions A, B, C and D were determined in accordance with the above-described technique by the use of an X-ray microanalyzer (X-ray Microanalyzer EMX-SM, produced by Shimazu Seisakusho Ltd.). The average grain size, coefficient of variation and average silver chloride content as thus obtained are shown in Table 2.

TABLE 2

| Emulsion | Average Grain Size (μm) | Coefficient of Variation (%) | Average AgCl Content (%) | Relative Standard Deviation of AgCl Content* (%) |
|---|---|---|---|---|
| A | 0.785 | 23.34 | 19.80 | 24 |
| B | 0.765 | 26.77 | 19.77 | 11 |
| C | 0.774 | 9.87 | 19.79 | 11 |
| D | 0.775 | 9.88 | 19.79 | 8 |

Note:
*Relative standard deviation of AgCl content = [(Standard deviation of AgCl content of individual grains)/(average AgCl content)] × 100

Each of Emulsions A to D was kept at 40° C. for a prescribed period of time (i.e., 30 minutes, 2 hours or 4 hours) and then coated on a polyethylene-laminated paper support according to the specifications shown below. A protective layer as shown below was further coated thereon. The resulting light-sensitive material was designated as Sample A, B, C or D, respectively.

Layer Structure:

(1) Emulsion Layer:

| | |
|---|---|
| Emulsion A, B, C or D | 0.38 g-Ag/m$^2$ |
| Gelatin | 1.41 g/m$^2$ |
| Coupler of the formula: | 7.22 × 10$^{-4}$ mol/m$^2$ |

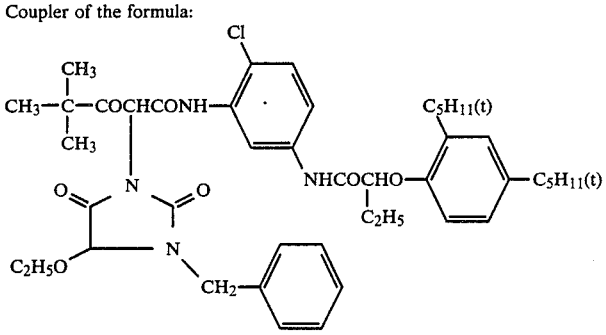

| | |
|---|---|
| Color image stabilizer of the formula: | 1.35 × 10$^{-4}$ mol/m$^2$ |

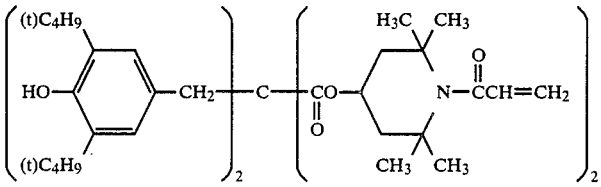

| | |
|---|---|
| Solvent [$(C_9H_{19}O)_3P{=}O$] | 0.08 g/m$^2$ |

(2) Protective Layer:

| | |
|---|---|
| Gelatin | 1.33 g/m$^2$ |

Figure 2:
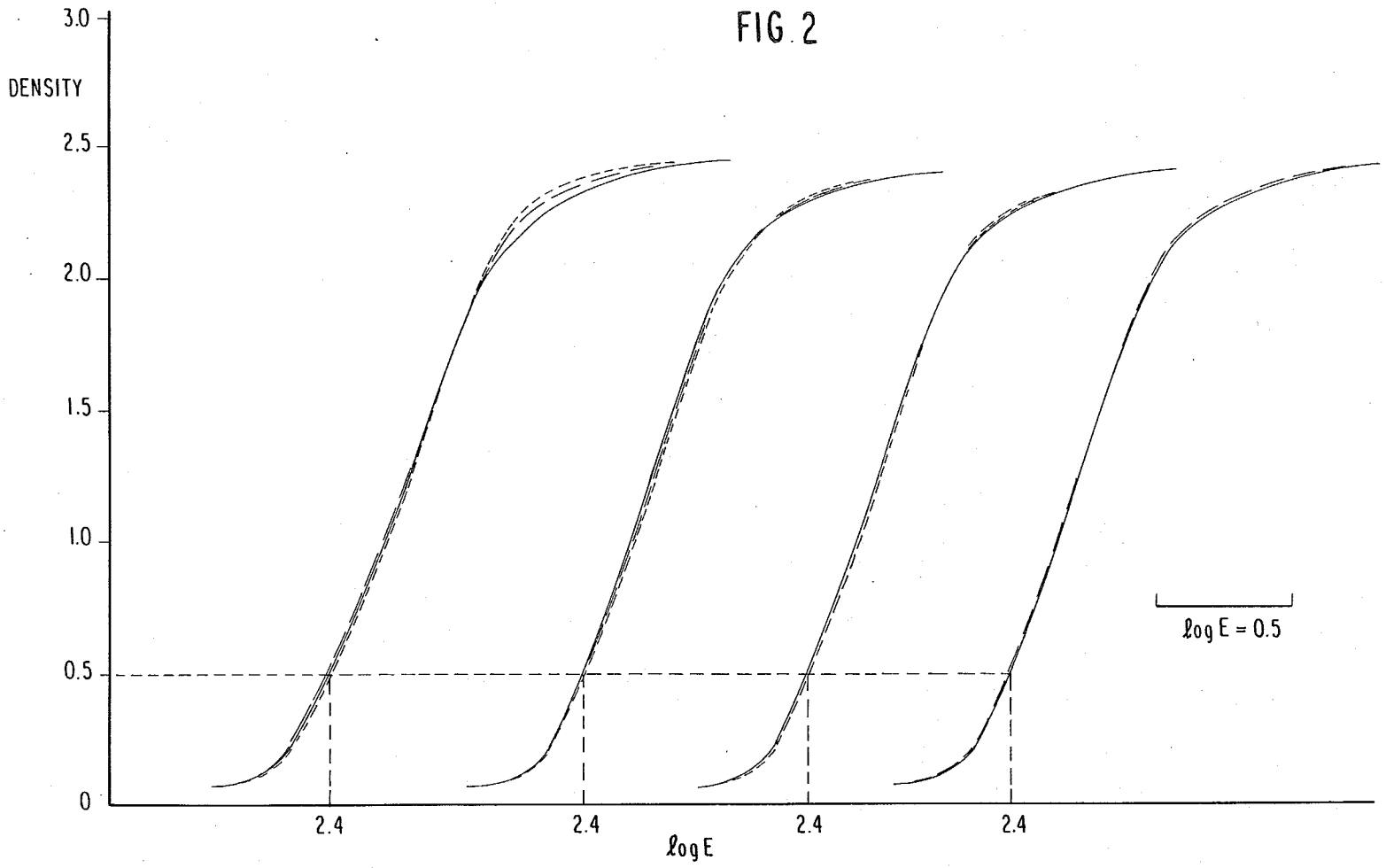
FIG. 2 shows characteristic curves of Samples A, B, C and D as prepared in the Example described herein in order from left to right, in which the abscissa indicates an exposure (log E) (the unit of E is C.M.S.) and the ordinate indicates an optical density (D); the solid, broken and dotted lines represent the time periods during which the photographic emulsions are in a liquid state at 30 minutes, 2 hours and 4 hours, respectively.

After drying at 40° C. for 16 hours, each of Samples A to D was exposed to light at 250 CMS for 0.5 second. Changes in the characteristic curve with the different respective time periods during which the emulsion was kept in a liquid state are shown in FIG. 2. It can be seen from FIG. 2 in view of Table 2 that the variations in the characteristic curve due to the passage of time in a liquid state at 40° C. is smaller in Sample B than in Sample A and that Emulsion B has a larger coefficient of variation but a smaller relative standard deviation of silver chloride content than Emulsion A. It is considered, therefore, that the difference in degree of variations of the characteristic curve between Samples A and B is attributed to the difference in relative standard deviation of silver chloride content. Further, a comparison between Samples B and C reveals that Sample C exhibits less variations in the characteristic curve due to the passage of time in a liquid state at 40° C. while Emulsions C and B have the same relative standard deviation of silver chloride content, i.e., 11%. On the other hand, Emulsion C has a smaller coefficient of variation as compared with Emulsion B. Accordingly, it is believed that the difference in degree of variations of the characteristic curve between Samples B and C is attributed to the difference in coefficient of variations between Emulsions B and C.

It can be seen by comparing Samples C and D that the variations in the characteristic curve due to the passage of time in a liquid state at 40° C. is smaller in Sample D than in Sample C. Since Emulsion D has a larger coefficient of variation than Emulsion C, it is obvious that the reduced variations in the characteristic curve of Sample D is not brought about by the narrower grain size distribution of Emulsion D. On the other hand, the relative standard deviation of silver chloride content of Emulsion D is smaller than that of Emulsion C by 3%. Accordingly, the reduced variations in characteristic curve of Sample D is considered ascribable to the smaller relative standard deviation of silver chloride content of Emulsion D.

In light of the foregoing, one conclusion which may be drawn is that merely using an emulsion with a narrow grain size distribution is not sufficient for adequetely suppressing variations of the characteristic cirve when the emulsion is kept at 40° C. in a liquid state. Moreover, it is particularly important to make the halogen composition of the individual silver halide grains as uniform as possible.

As described above, the present invention makes it possible to minimize variations in photographic characteristics of a photographic emulsion during preservation in a liquid state from its preparation through the coating step.

The present invention also makes it possible to minimize variations in photographic characteristics due to variations in the composition of a developer (running solution).

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion having a composition of the formula:

$$AgBr_{1-x-y}Cl_xI_y$$

wherein x is a molar fraction satisfying the formula $0<x\leqq 0.6$, and y is a molar fraction satisfying the formula $0\leqq y\leqq 0.01$, wherein the relative standard deviation of the silver chloride content of individual silver halide grains is not more than about 20%.

2. A silver halide photographic emulsion as in claim 1, wherein the relative standard deviation of the silver chloride content of individual silver halide grains is not more than 10%.

3. A silver halide photographic emulsion as in claim 1, wherein said emulsion is a monodispersed emulsion.

4. A silver halide photographic emulsion as in claim 1, wherein x is from 0.05 to 0.55.

5. A silver halide photographic emulsion as in claim 4, wherein x is from 0.1 to 0.50.

6. A silver halide photographic emulsion as in claim 1, wherein said silver halide grains have an average grain size of from about 0.2 to about 1.3 μm.

7. A silver halide photographic emulsion as in claim 6, wherein the silver halide grains have an average grain size of from 0.3 to 1.0 μm.

8. A silver halide photographic emulsion as in claim 7, wherein the silver halide grains have an average grain size of from 0.4 to 0.8 μm.

9. A process for preparing a silver halide photographic emulsion having a composition of the formula:

$$AgBr_{1-x-y}Cl_xI_y$$

wherein x is a molar fraction satisfying the formula $0<x\leqq 0.6$, and y is a molar fraction satisfying the formula $0\leqq y\leqq 0.01$, wherein the relative standard deviation of the silver chloride content of individual silver halide grains is not more than about 20%, which comprises the following steps: (1) adding an aqueous solution of silver nitrate and an aqueous solution of alkali metal halides to an aqueous gelatin solution of an alkali metal halide while maintaining the pAg value of the liquid phase in which silver halide grains are formed within a range of from about 6.0 to about 10.0, (2) subjecting the mixture of physical ripening at a temperature of from about 40° C. to about 75° C., (3) stopping said physical ripening before substantial increases in grain size distribution occur, and then (4) desalting a silver halide emulsion.

10. A process as in claim 9, wherein the pAg value in the liquid phase is maintained within a range of from 6.5 to 9.0.

11. A process as in claim 1, wherein said silver halide grains have normal crystals.

12. A process as in claim 11, wherein said silver halide grains hve cubic crystals or octahedral crystals.

* * * * *